US005415090A

United States Patent [19]

Natori et al.

[11] Patent Number: 5,415,090

[45] Date of Patent: May 16, 1995

[54] METHOD FOR MANUFACTURING A PRINTING MASTER USING THERMOSENSITIVE STENCIL PAPER

[75] Inventors: Yuji Natori, Shizuoka; Hiroshi Tateishi, Fujinomiya, both of Japan

[73] Assignees: Ricoh Company, Ltd., Tokyo; Tohoku Ricoh Co., Ltd., Miyagi, both of Japan

[21] Appl. No.: 168,228

[22] Filed: Dec. 17, 1993

[30] Foreign Application Priority Data

Dec. 17, 1992 [JP] Japan ..... 4-355184
Sep. 7, 1993 [JP] Japan ..... 5-221544

[51] Int. Cl.[6] ..... B41C 1/055; B41C 1/14

[52] U.S. Cl. ..... 101/128.21; 400/120.01; 347/206

[58] Field of Search ..... 101/127, 128.21, 128.4, 101/129; 400/120.01; 346/76 PH

[56] References Cited

U.S. PATENT DOCUMENTS 4,947,183 8/1990 Yagino ..... 400/120
5,063,394 11/1991 Nagato ..... 400/120
5,091,257 2/1992 Nonogaki et al. ..... 428/411.1
5,188,881 2/1993 Sugiyama et al. ..... 428/143
5,216,951 6/1993 Yokoyama et al. ..... 101/128.4
5,219,637 6/1993 Arai et al. ..... 428/195

FOREIGN PATENT DOCUMENTS 53047 3/1986 Japan ..... 101/128.4
173256 7/1987 Japan ..... 101/128.21
283991 11/1988 Japan ..... 101/128.21
234924 9/1989 Japan ..... 101/128.21
7197 1/1992 Japan ..... 101/128.21
357094 12/1992 Japan ..... 101/128.4

*Primary Examiner*—Edgar S. Burr
*Assistant Examiner*—Stephen R. Funk
*Attorney, Agent, or Firm*—Oblon, Spivak, McClelland, Maier, & Neustadt

[57] ABSTRACT

A method of manufacturing a printing master by forming perforations in a thermosensitive stencil paper. Thermal energy is applied by a thermal head to the stencil paper, the other side of the paper being free from contact with any other element at a location opposite the thermal head while thermal energy is applied.

10 Claims, 4 Drawing Sheets

METHOD FOR MANUFACTURING A PRINTING MASTER USING THERMOSENSITIVE STENCIL PAPER

BACKGROUND OF THE INVENTION

1. Field of the Invention

The present invention relates to a method of speedily manufacturing a printing master using a thermosensitive stencil paper which is capable of yielding high quality images, without decreasing the durability of the members of a printing machine.

2. Discussion of Background

Conventionally, a printing system using a stencil paper is widely utilized because of the advantage of convenience. In this kind of printing system, a thermosensitive stencil paper is prepared by attaching a thermoplastic resin film to a porous substrate with an ink-permeability property. As the thermosensitive stencil paper thus prepared is brought into pressure contact with a thermal head with the application of pressure to the thermosensitive stencil paper using a pressure-application roller, signals are applied to the thermal head. The thermoplastic resin film is partially melted in accordance with the signals, thereby forming perforations in the thermosensitive resin film imagewise corresponding to the signals. Then, a printing ink applied to the thermosensitive stencil paper from the porous substrate side permeates through the porous substrate to be ready for printing images on an image-receiving medium such as a sheet of paper.

However, when the thermal energy is applied to the thermosensitive stencil paper comprising the porous substrate and the thermoplastic resin film attached to the porous substrate to form the perforations therein, the thermal energy required to perforate a portion of the thermoplastic resin film where the substrate is attached via an adhesive agent is larger than the thermal energy required to perforate the other portion of the thermoplastic resin film which is not supported by the substrate, that is, corresponding to a pore of the substrate. Therefore, there is the problem that a perforation formed in the thermoplastic resin film at a position where the substrate is substantially attached to the thermoplastic resin film may become small, or the perforations cannot be formed perfectly. As a result, clear images cannot be obtained on the image-receiving medium because of unevenness of the perforations formed in the thermosensitive stencil paper.

To prevent the formation of uneven perforations, it is proposed to supply an excessive amount of thermal energy to the thermal head for the perforation of the thermosensitive stencil paper. However, this curtails the life of the thermal head, and causes the burnout in the thermal head to induce the occurrence of abnormal images.

Furthermore, another problem of the thermosensitive stencil paper comprising the porous substrate and the thermoplastic resin layer attached thereto is that the printing ink cannot smoothly permeate through the porous substrate such as Japanese paper. Therefore, uniform images cannot be obtained on the image-receiving medium.

There is proposed a method of printing images on the image-receiving medium using as a printing master a thermosensitive stencil paper substantially consisting of a thermoplastic resin film. The method of manufacturing a printing master using a thermosensitive stencil paper consisting of a thermoplastic resin film is conventionally known as disclosed in Japanese Laid-Open Patent Applications 53-49519, 54-33117, 3-45719, 3-45720 and 62-282983. In the conventional manufacturing methods of the printing master as proposed in the above-mentioned applications, one surface of the thermosensitive stencil paper is brought into contact with a heating element of the thermal head, with the thermosensitive stencil paper being pressed from the opposite surface thereof toward the heating element using a pressure-application platen roller.

In this case, however, a part of the thermal energy supplied to the thermosensitive stencil paper by the heating element of the thermal head is caused to escape to the pressure-application platen roller when the thermal energy is applied to the thermosensitive stencil paper consisting of the thermoplastic resin film which is in pressure contact with the pressure-application platen roller. Consequently, a sufficient amount of thermal energy required to perforate the thermosensitive stencil paper is not supplied to the thermosensitive stencil paper due to the above-mentioned thermal loss.

To solve the aforementioned problem of the thermal loss, the inventors of the present invention have proposed a method of increasing the heat-insulating properties of the pressure-application platen roller by employing a material with a low thermal conductivity for the pressure-application platen roller, as disclosed in Japanese Patent Application 4-61339.

However low the thermal conductivity of the material is used for the pressure-application platen roller, the thermal loss is not evitable in practice because the thermosensitive stencil paper is brought into pressure contact with the platen roller. This causes some failure in the perforation of the thermosensitive stencil paper.

Furthermore, when a printing master is prepared using the thermosensitive stencil paper consisting of the thermoplastic resin film under the circumstances of low humidity, there is the problem that the thermoplastic resin film is electrostatically charged. As a result, the thermoplastic resin film is electrostatically attached to a member of the printing machine, so that a satisfactory printing master cannot be obtained.

It is difficult to meet both of the requirements for the manufacturing method of a printing master, that is, to produce the printing master speedily without decreasing the durability of the members of the printing machine, and to obtain the printing master capable of yielding high quality images.

SUMMARY OF THE INVENTION

Accordingly, a first object of the present invention is to provide a method of manufacturing a printing master using a thermosensitive stencil paper, free from the above-mentioned conventional drawbacks, capable of clearly forming desired perforations in the thermosensitive stencil paper by the application of a small amount of thermal energy thereto with the thermal loss being minimized.

A second object of the present invention is to provide a method of manufacturing a printing master using a thermosensitive stencil paper, capable of obtaining the printing master which is not electrostatically charged.

The above-mentioned objects of the present invention can be achieved by a method of manufacturing a printing master using a thermosensitive stencil paper comprising a thermoplastic resin film, comprising the step of forming perforations in the thermosensitive stencil paper by applying thermal energy to one surface of the thermosensitive stencil paper through heat application means in such a fashion that the other surface of the thermosensitive stencil paper opposite to the above-mentioned surface thereof is substantially in contact with air.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

It has been found in the study of the manufacturing process of the printing master using a thermosensitive stencil paper comprising a thermoplastic resin film that the thermal conductivity of one surface of the thermoplastic resin film which is opposite to the surface in contact with the heat application means such as a thermal head having a plurality of heating elements becomes an important factor in efficiently utilizing the thermal energy supplied by the heat application means to form the perforations in the thermosensitive stencil paper.

According to the present invention, the surface of the thermosensitive stencil paper which is not in contact with the heating elements of a thermal head is substantially in contact with air. Therefore, the loss of thermal energy supplied from the thermal head can be minimized, so that the desired perforations can accurately be formed in the thermosensitive stencil paper. In addition, the failure in the preparation of the printing master due to the generation of electrostatic charge on the thermosensitive stencil paper can be prevented.

A first embodiment of the method of manufacturing a printing mater using the thermosensitive stencil paper according to the present invention will now be explained in detail by referring to FIGS. 1 to 3.

Figure 1:
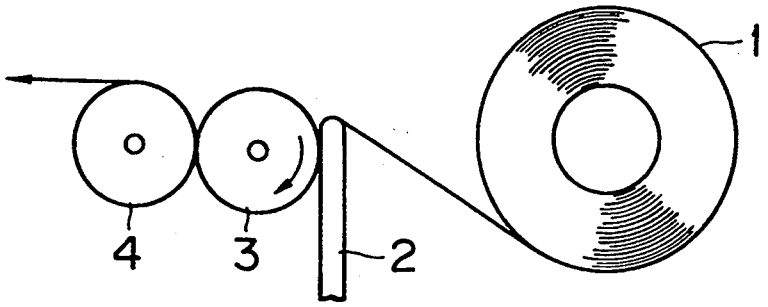
FIG. 1 is a schematic front view which shows a first embodiment of the present invention.

As shown in FIG. 1, the thermal energy is applied to a thermosensitive stencil paper 1 by an edge-type thermal head 2. In this embodiment, the thermal head 2, which is designed to have heating elements at the edge portion of the body, has basically the same structure as that used in a thermal printer. Reference numerals 3 and 4 indicate transporting rollers.

Figure 2:
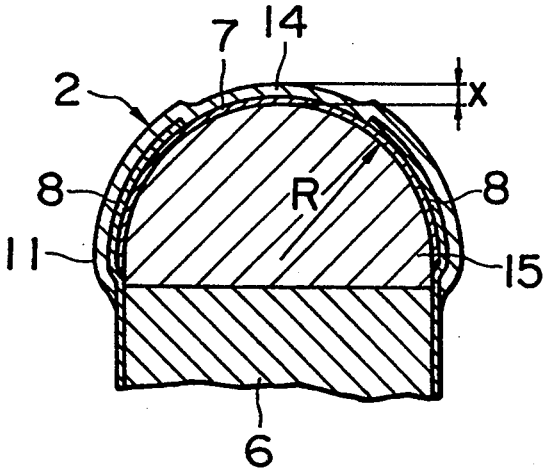
FIG. 2 is an enlarged vertical section of a detailed portion as shown in FIG. 1.

FIG. 2 is an enlarged vertical section of the edge portion of the thermal head 2 shown in FIG. 1. As shown in FIG. 2, the thermal head 2 is constructed in such a manner that a half-round glass-glazed layer 15 is provided on the edge portion of an electrically-insulating substrate 6. A plurality of heating elements 7 substantially in the shape of rectangles are formed on the glass-glazed layer 15 by vacuum-deposition of metals such as NiCr and Ta. Further, on each heating element 7, wires 8 made of aluminum are provided to supply electricity to the heating element 7. A protective layer 11 is further provided to protect the heating elements 7 and wires 8. The protective layer 11 comprises a material such as $SiO_2$ capable of protecting the heating elements 7 from oxidation and a material such as $Ta_2O_5$ capable of protecting the heating elements 7 and wires 8 from friction with the thermosensitive stencil paper 1.

Figure 3:
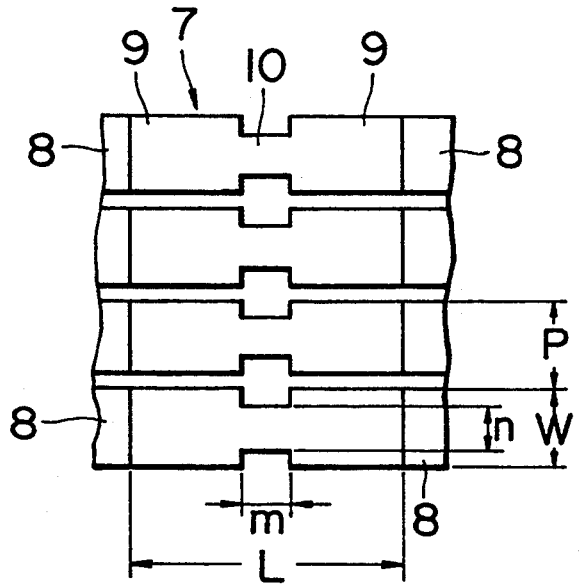
FIG. 3 is an enlarged schematic plan view of heat elements as shown in FIG. 1.

FIG. 3 is an enlarged plan view of the heating elements 7 as shown in FIG. 2. In the embodiment as shown in FIG. 3, the width "n" of a central portion 10 of the heating element 7 is smaller than the width "w" of an end portion 9 thereof. The sectional area of the heating element 7 in the direction perpendicular to the sub-scanning direction becomes maximum at the end portion 9 of the heating element 7, namely, at a position where the heating element 7 and the wire 8 are joined together or a portion adjacent to the above-mentioned joint position. Thus, portions with wide sectional areas (hereinafter referred to as the heating element end portions 9) are formed at both ends of the heating element 7, and a portion with a narrow sectional area (hereinafter referred to as a heating element central portion 10) is formed in the center of the heating element 7. The heating element 7 is in the form of a capital letter "I" with a length of "L" in the sub-scanning direction. The length of the heating element central portion 10 is represented by "m". Because of the above-mentioned indented central portion 10 of the heating element 7, the thermal energy is concentrated on the heating element central portion 10.

The surface 14 of the protective layer 11 corresponding to the heating element central portion 10 which comes in contact with the thermosensitive stencil paper 1, which is hereinafter referred to as the contact surface 14 as shown in FIG. 2, is caused to stick out by a thickness "x" from the edge of the electrically-insulating substrate 6 of the heating element 7 due to the thickness of the protective layer 11 and the thickness of the heating element central portion 10. Therefore, the sectional area of the heating element central portion 10 can be decreased as the length "L" of the heating element 7 is increased more than a pitch "P" in the main-scanning direction. As a result, a curvature radius R of the electrically-insulating substrate 6 as shown in FIG. 2 can be set at a relatively large value, so that the contact surface 14 of the heating element 7 can surely be brought into contact with the thermosensitive stencil paper 1 without providing the pressure-application platen roller.

For instance, the size of the heating element can be determined as follows:

The pitch "P" in the main-scanning direction: 62.5 μm, the length "L" of the heating element 7 in the sub-scanning direction: 150 to 200 μm, the width "w" of the heating element end portion 9: 50 to 60 μm, the width "n" of the heating element central portion 10 in the main-scanning direction: 30 to 50 μm, and the length "m" of the heating element central portion 10 in the sub-scanning direction: 30 to 60 μm.

When the thickness of the heating element 7 is 1 μm, the sectional area (Sp) of the heating element end portion 9 is in the range from 50 to 60 $\mu m^2$, and the sectional area (Sc) of the heating element central portion 10 is in the range from 30 to 50 $\mu m^2$.

When the thickness of the protective layer 11 at the contact surface 14 is 10 μm or less, it is easy that the size of the heating element central portion 10 correspond to that of a perforation. In practice, it is preferable that the thickness of the protective layer 11 at the contact surface 14 be in the range from 3.5 to 7 μm. When the thickness of the protective layer is within the above range, the durability of the thermal head 2 is not decreased, and the shrinkage of the thermoplastic resin film can be prevented in the preparation of a printing master because the heat energy is not accumulated in the protective layer 11, so that any crease that may have an adverse effect on the obtained images is not generated in the thermoplastic resin film.

As previously explained, in the case where the edge-type thermal head as shown in FIG. 2 is employed in the present invention, the sectional area of the heating element is maximum at the heating element end portion 9. Therefore, the temperature of the heating element end portion cannot sufficiently be elevated so as to perforate the thermosensitive stencil paper even if the number of heating elements per unit length in the main-scanning direction is increased, and the number of heating times per unit length in the sub-scanning direction is increased. Only the heating element central portion 10 can sufficiently be heated to perforate the thermosensitive stencil paper in practice. As a result, the following advantages can be obtained:

(1) Since the contact surface 14 of the protective layer 11 of the heating element 7 corresponding to the heating element central portion 10 is allowed to stick out, the diameter of a perforation can be controlled by adjusting the size of the heating element central portion 10 without extremely increasing the length of the heating element in the sub-scanning direction as compared with the length of the heating element in the main-scanning direction. Consequently, a printing master with clear-cut perforations can be obtained, and the plate wear of the printing master is improved and the printing operation can be carried out without the problem of offset.

(2) Since it is possible to ensure a sufficient length of the heating element 7, it is not necessary to decrease the curvature radius of the edge portion of the heating element 7 for the purpose of protruding the surface of the heating element 7 which is in contact with the thermosensitive stencil paper 1 as in the conventional edge-type thermal head. As a result, the decrease of the durability of the thermal head 2 which results from the decrease of the mechanical strength of the edge portion of the heating element 7 can be prevented.

(3) Since the contact surface 14 of the heating element 7 is protruded, it is not necessary that the thermosensitive stencil paper 1 be forcibly brought into pressure contact with the contact surface 14 of the heating element 7 with the application of pressure to the thermosensitive stencil paper 1 using a pressure-application platen roller or the like. As a result, it is possible to prevent the thermal energy supplied to the thermosensitive stencil paper 1 by the thermal head 2 from escaping to the platen roller, so that the perforations can be formed uniformly in the thermosensitive stencil paper 1. In other words, the thermal energy inputted by the thermal head 2 can be utilized for perforating the thermosensitive stencil paper 1 with high efficiency.

A second embodiment of the present invention will now be explained in detail by referring to FIGS. 4 and 5.

In this embodiment, a partially-glazed thin-film type thermal head 2A, which has basically the same structure as used in the thermal printer is employed. As shown in FIG. 5, the thermal head 2A is constructed in such a manner that a half-round glazed layer 15 is formed on an electrically-insulating substrate 6, a plurality of heating elements 7 are provided on the glazed layer 15, and wires 8 are formed on each heating element 7 to supply electricity to the heating element 7. The wires 8 are separated from each other by etching of the glazed layer 15.

Figure 4:
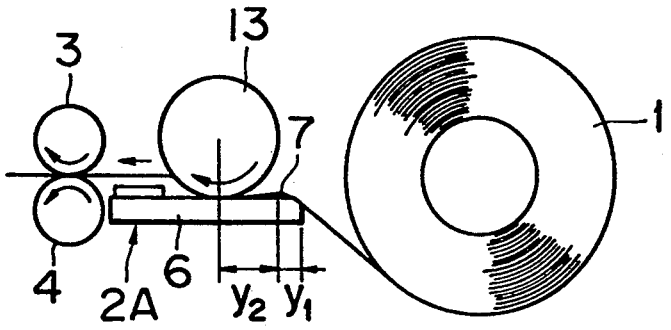
FIG. 4 is a schematic front view which shows a second embodiment of the present invention.

In this embodiment as shown in FIG. 4, a platen roller 13 is provided to transport a thermosensitive stencil paper 1. In this case, the pressure is not applied to the thermosensitive stencil paper 1 by the platen roller 13 at a position where the thermosensitive stencil paper 1 is in contact with the heating element 7 of the thermal head 2A.

In the embodiment as shown in FIG. 4, a distance $y_1$ between the end of the thermal head 2A and the center of the heating element 7, and a distance $y_2$ between the center of the heating element 7 and the point of contact of the platen roller 13 and the thermal head 2A may be as short as possible. It is preferable that the distances $y_1$ and $y_2$ be not more than 10 times the height from the flat surface of the electrically-insulating substrate 6 of the thermal head 2A to the contact surface 14 thereof. When the distances $y_1$ and $y_2$ are within the above-mentioned range, the thermosensitive stencil paper 1 can be brought into contact with the contact surface 14 of the heating element 7 in good conditions, so that the perforations can be formed in the thermosensitive stencil paper 1 satisfactorily. Furthermore, the current capacity is not decreased, so that the ratio of the number of heating elements capable of heating at one time to the entire number of heating elements can be increased in the preparation of the printing master, with the result that the manufacturing speed of the printing master can be increased.

Figure 6:
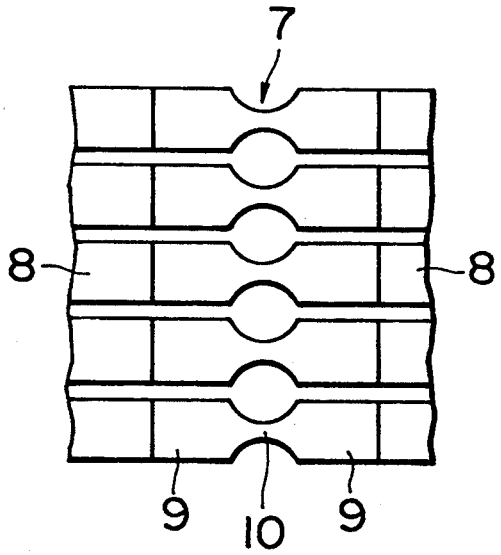
FIG. 6 is an enlarged schematic plan view in explanation of one embodiment of heat elements as shown in FIG. 4.
Figure 7:
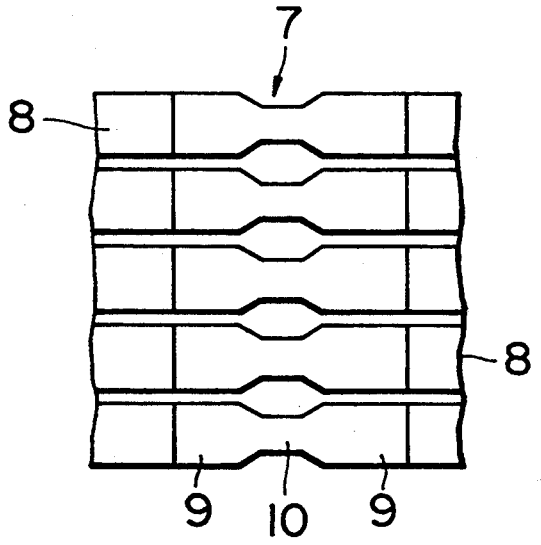
FIG. 7 is an enlarged schematic plan view in explanation of another embodiment of heat elements as shown in FIG. 4.

The heating elements 7 for use in the thermal head 2A can be modified as shown in FIGS. 6 and 7.

Figure 5:
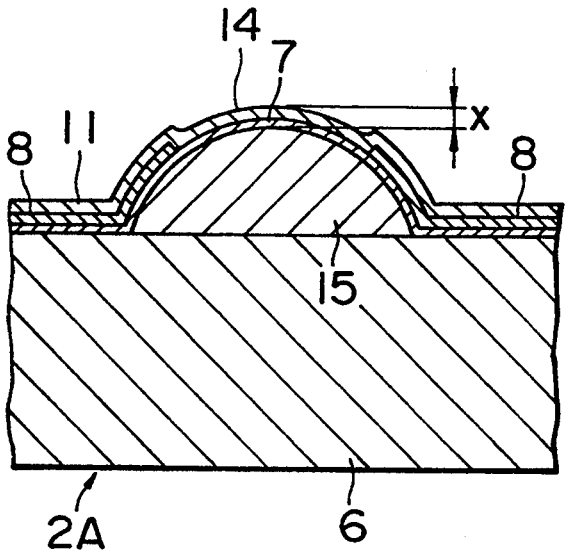
FIG. 5 is an enlarged vertical section of a detailed portion as shown in FIG. 4.

As previously explained, in the case where the partially-glazed type thermal head as shown in FIG. 5 is employed in the present invention, the sectional area of the heating element is maximum at the heating element end portion 9. Therefore, the heating element end portion 9 is not heated to such a temperature that the thermosensitive stencil paper 1 can be perforated even though the number of heating elements per unit length in the main-scanning direction is increased, and the number of heating times per unit length in the sub-scanning direction is increased. Only the heating element central portion 10 is heated to a sufficiently high temperature to perforate the thermosensitive stencil paper in practice. As a result, the following advantages can be obtained:

(1) Since the contact surface 14 of the protective layer 11 of the heating element 7 corresponding to the heating element central portion 10 is caused to stick out, the diameter of a perforation can be controlled by adjusting the size of the heating element central portion 10 without extremely increasing the length of the heating element 7 in the sub-scanning direction as compared with the length of the heating element 7 in the main-scanning direction. Consequently, a printing master with clear-cut perforations can be obtained, and the plate wear of the printing master is improved and the printing operation can be carried out without the problem of offset.

(2) Since the contact surface 14 of the heating element 7 is protruded, it is not necessary that the thermosensitive stencil paper 1 be brought into pressure contact with the contact surface 14 of the heating element 7 with the application of pressure to the thermosensitive stencil paper 1 using a pressure-application platen roller or the like. As a result, it is possible to prevent the thermal energy supplied to the thermosensitive stencil paper 1 by the thermal head from escaping to the platen roller, so that the perforations can be formed uniformly in the thermosensitive stencil paper 1. In other words, the thermal energy inputted by the thermal head 2A can be utilized for perforating the thermosensitive stencil paper 1 with high efficiency.

The thermosensitive stencil paper for use in the present invention comprises the thermoplastic resin film. The thermoplastic resin film is made out of a thermoplastic resin by extrusion or flow casting. Examples of the thermoplastic resin for use in the present invention include polyesters such as polyethylene terephthalate, polyethylene-2,6-naphthalate, polyethylene $\alpha,\beta$-bis(2-chlorophenoxy)ethane-4,4-dicarboxylate and polycarbonate; polyolefins such as polyethylene, polypropylene, ethylene-vinyl acetate copolymer, polybutadiene, polystyrene and polymethyl pentene; polyamides such as polyhexamethylene adipate (nylon 66), poly $\epsilon$-caprolactam (nylon 6) and nylon 610; halogenated polymers such as polyvinylidene chloride, polyvinylidene fluoride and polyvinyl fluoride; vinyl polymers such as polyacrylonitrile and polyvinyl alcohol; and others such as polyacetal, polyether sulfone, polyether ketone, polyphenylene ether, polysulfone, polyphenylene sulfide, and copolymers and mixtures comprising the above-mentioned monomers.

A thermoplastic resin with high sensitivity to thermal performation is preferably employed in the present invention. In other words, it is preferable that the state of a thermoplastic resin film be substantially amorphous. The thermoplastic resin film substantially in an amorphous state can be identified by differential scanning calorimetry (DSC) because there is no peak in the graph of the DSC analysis.

Further, the degree of crystallinity of the thermoplastic resin film may be 15% or less. When the degree of crystallinity of the thermoplastic resin film is 15% or less, the thermal energy supplied to the thermoplastic resin film to perforate the same by the thermal head is not wasted on melting the crystals of the thermoplastic resin, thereby preventing the decrease of the perforation efficiency. In this case, the degree of crystallinity of the thermoplastic resin film, which is generally determined by the result of X-ray analysis, may be obtained from the peak area indicated by the graph of the DSC analysis. The thermoplastic resin film substantially in the amorphous state can be obtained by fabricating a film out of a resin which originally shows no peak in the DSC analysis, or a resin subjected to a special treatment such as rapid cooling to prevent the crystallization of the resin in the preparation of the film.

When the thermoplastic resin film with a low degree of crystallinity is employed as the thermosensitive stencil paper in the present invention, the thermal energy supplied to the thermosensitive stencil paper by the thermal head can be prevented from being used to melt the crystals of the resin, and the loss of thermal energy can thus be minimized even though the applied thermal energy is small, so that the thermal perforation can be achieved efficiently.

It is preferable that the thickness of the thermoplastic resin film serving as the thermosensitive stencil paper for use in the present invention be in the range from 0.5 to 30 $\mu$m, and more preferably in the range from 0.7 to 20 $\mu$m. When the thickness of the thermoplastic resin film is within the above-mentioned range, the plate wear of the thermosensitive stencil paper obtained as the printing master does not decrease because the mechanical strength of the stencil paper is sufficient, and at the same time, the perforations can readily be formed in the thermosensitive stencil paper without the occurrence of crease in the preparation of the printing master.

In addition, it is preferable that the melting initiation temperature of the thermoplastic resin film be in the range from 50° to 300° C., and more preferably in the range from 70° to 290° C. When the thermoplastic resin film has such a melting initiation temperature, an excessive amount of the thermal energy is not required to perforate the thermoplastic resin film when the thermal energy is supplied by the thermal head to the thermoplastic resin film. In addition, the thermoplastic resin film with the above-mentioned melting initiation temperature can be manufactured with no difficulty, and the preservability is not decreased.

To prevent the thermoplastic resin film from thermally sticking to the surface of the thermal head, for instance, a fatty acid metallic salt, a phosphoric ester surface active agent, a silicone oil, and a fluorine-containing compound with a perfluoroalkyl group may uniformly be coated on the surface of the thermoplastic resin film which is in contact with the thermal head. In this case, it is preferable that the coating amount of the above-mentioned agent for preventing the thermal sticking be in the range from 0.001 to 2 g/m$^2$, and more preferably in the range from 0.005 to 1 g/m$^2$.

Furthermore, to impart the antistatic properties to the thermoplastic resin film, an antistatic agent may be coated on the thermoplastic resin film uniformly, or contained in the thermoplastic resin film.

When the antistatic agent is coated on the thermoplastic resin film, the antistatic agents for general use, for example, an anionic surface active agent such as an organic sulfonic acid metallic salt, a carboxylate or an alkylphosphoric ester; a cationic surface active agent such as an amineguanidine salt or a quaternary ammonium salt; and a nonionic surface active agent such as sorbitan, ether, ester, alkylamine and amide of polyoxyethylene can be used. It is preferable that the coating amount of the antistatic agent be in the range from 0.001 to 2.0 g/m$^2$, and more preferably in the range from 0.01 to 0.5 g/m$^2$.

When the antistatic agent is contained in the thermoplastic resin film, an organic sulfonic acid metallic salt, polyalkylene oxide and quaternary ammonium salt can be used alone or in combination as the antistatic agent.

The organic sulfonic acid metallic salt used as the antistatic agent for use in the present invention is a compound represented by the formula of $RSO_3X$, wherein R is an aliphatic group, an alicyclic group or an aromatic group; and X is a metal such as Na, K or Li. For example, alkysulfonic acid metallic salt and alkylbenzenesulfonic acid metallic salt can be employed.

Examples of the alkyl moiety of the above-mentioned metallic salts include octyl, decyl, dodecyl (lauryl), tetradecyl (myristyl), hexadecyl, and octadecyl (stearyl). Specific examples of the alkylsulfonic acid metallic salt and alkylbenzenesulfonic acid metallic salt are sodium laurylsulfonate, potassium laurylsulfonate, lithium laurylsulfonate, sodium stearylsulfonate, potassium stearylsulfonate, lithium stearylsulfonate, sodium dodecylbenzenesulfonate, potassium dodecylbenzenesulfonate, and lithium dodecylbenzenesulfonate.

When the organic sulfonic acid metallic salt is contained in the thermoplastic resin film, it is preferable that the ratio by weight of the organic sulfonic acid metallic salt to the total weight of the thermoplastic resin film be in the range from (0.1:100) to (2:100), and more preferably in the range from (0.2:100) to (1.5:100). When the amount of the organic sulfonic acid metallic salt is within the above range, the obtained antistatic effect is sufficient, and the increase of the surface roughness of the thermoplastic resin film caused by the addition of the antistatic agent is not serious.

When the polyalkylene oxide is contained as the antistatic agent in the thermoplastic resin film, polyethylene oxide, polypropylene oxide, polyethylene-propylene oxide polymer, and polytetramethylene oxide can be employed. The molecular weight of the polyalkylene oxide is preferably in the range from 400 to 500,000, more preferably in the range from 1,000 to 50,000. It is preferable that the ratio by weight of the polyalkylene oxide to the total weight of the thermoplastic resin film be in the range from (0.1:100) to (5:100), and more preferably in the range from (0.2:100) to (4:100). When the amount of the polyalkylene oxide is within the above range, the obtained antistatic effect is sufficient, and the decrease of the mechanical characteristics of the obtained resin film can be prevented.

In addition, a conductivity-imparting agent may be contained in the thermoplastic resin film. As the conductivity-imparting agent for use in the present invention, a quaternary ammonium salt represented by the following formula is employed alone or in combination:

$$[R—N(CH_3)_2—R']X$$

wherein R is an alkyl group having 12 to 18 carbon atoms; R′ is an alkyl group having 12 to 18 carbon atoms or methyl group; and X is Cl or Br.

It is preferable that the ratio by weight of the quaternary ammonium salt serving as the conductivity-imparting agent to the total weight of the thermoplastic resin film be in the range from (1:100) to (50:100), and more preferably in the range from (2:100) to (30:100).

Other features of this invention will become apparent in the course of the following description of exemplary embodiments, which are given for illustration of the invention and are not intended to be limiting thereof.

EXAMPLE 1

A thermoplastic resin comprising a polyester was made into a film with a thickness of 1.8 μm, which was substantially in the amorphous state with a degree of crystallinity of 1.0%. The melting temperature of the thermoplastic resin film was 160° C. A commercially available phosphoric ester surface active agent "GAFAC RL210" (Trademark), made by Toho Chemical Industry Co., Ltd. with a melting point of 54° C. was coated on the surface of the thermoplastic resin film which was in contact with a thermal head in a deposition amount of 0.1 g/m$^2$ to prevent the thermoplastic resin film from thermally sticking to the thermal head. Thus, a thermosensitive stencil paper No. 1 for use in the present invention was obtained.

Using the thus obtained thermosensitive stencil paper No. 1, a printing master including solid image areas was prepared in such a fashion that the thermal energy of 0.050 mJ/dot was imagewise applied to the thermosensitive stencil paper No. 1 by a partially-glazed thin film line thermal head with a dot density of 16 dot/mm, without providing a platen roller at a position where the thermosensitive stencil paper No. 1 faced to a heating element of the thermal head. The conditions of the partially-glazed thin film line thermal head were as follows:

The length of the heating element in the main-scanning direction (Lm): 45 μm, the length of the heating element in the sub-scanning direction (Ls): 90 μm, the sectional area of the heating element end portion (Sp): 45 μm$_2$, the sectional area of the heating element central portion (Sc): 45 μm$^2$, the thickness of a protective layer of the heating element (T): 4.0 μm, and the feeding pitch in the sub-scanning direction in preparation of the printing master (Ps): 62.5 μm/line.

The thus prepared printing master was set to a commercially available printing machine "PRIPORT SS 955" (Trademark), made by Ricoh Company, Ltd., and printing operation was carried out. As a result, solid images with excellent uniformity were obtained.

EXAMPLE 2

A thermoplastic resin comprising a polyester was made into a film with a thickness of 1.8 μm, which was substantially in the amorphous state with a degree of crystallinity of 1.0%. The melting temperature of the thermoplastic resin film was 160° C. A commercially available phosphoric ester surface active agent "GAFAC RL210" (Trademark), made by Toho Chemical Industry Co., Ltd. with a melting point of 54° C. and dodecyl trimethylammonium chloride represented by the formula of $C_{12}H_{25}N(CH_3)_2CH_3Cl$, serving as an antistatic agent were mixed with a ratio by weight of 1:1, and the mixture was coated on the surface of the thermoplastic resin film which was in contact with a thermal head in a deposition amount of 0.2 g/m$^2$. Thus, a thermosensitive stencil paper No. 2 for use in the present invention was obtained.

Using the thus obtained thermosensitive stencil paper No. 2, a printing master including solid image areas was prepared in such a fashion that the thermal energy of 0.050 mJ/dot was imagewise applied to the thermosensitive stencil paper No. 2 by a partially-glazed thin film line thermal head with a dot density of 16 dot/mm, without providing a platen roller at a position where the thermosensitive stencil paper No. 2 faced to a heating element of the thermal head. The conditions of the partially-glazed thin film line thermal head were as follows:

The length of the heating element in the main-scanning direction (Lm): 45 μm, the length of the heating element in the sub-scanning direction (Ls): 90 μm, the sectional area of the heating element end portion (Sp): 40 μm$_2$, the sectional area of the heating element central portion (Sc): 40 $\mu m^2$, the thickness of a protective layer of the heating element (T): 4.0 $\mu m$, and the feeding pitch in the sub-scanning direction in preparation of the printing master (Ps): 62.5 $\mu m$/line.

The thus prepared printing master was set to a commercially available printing machine "PRIPORT SS 955" (Trademark), made by Ricoh Company, Ltd., and printing operation was carried out. As a result, solid images with excellent uniformity were obtained.

Furthermore, there was no problem caused by the generation of electrostatic charge on the thermosensitive stencil paper No. 2 when the printing master was prepared, and when the printing master was wound around the printing drum.

EXAMPLE 3

A thermoplastic resin comprising a polyester was made into a film with a thickness of 1.8 $\mu m$, which was substantially in the amorphous state with a degree of crystallinity of 1.0%. The melting temperature of the thermoplastic resin film was 160° C. An organic sulfonic acid metallic salt represented by the formula of $C_{12}H_{37}SO_3Na$ serving as an antistatic agent was contained in the thermoplastic resin film in the ratio by weight of 1.5 to 100. In addition, a commercially available phosphoric ester surface active agent "GAFAC RL210" (Trademark), made by Toho Chemical Industry Co., Ltd. with a melting point of 54° C. was coated on the surface of the thermoplastic resin film which was in contact with a thermal head in a deposition amount of 0.1 g/$m^2$ to prevent the thermoplastic resin film from thermally sticking to the thermal head. Thus, a thermosensitive stencil paper No. 3 for use in the present invention was obtained.

Using the thus obtained thermosensitive stencil paper No. 3, a printing master including solid image areas was prepared in the same manner as in Example 1.

The thus prepared printing master was set to a commercially available printing machine "PRIPORT SS 955" (Trademark), made by Ricoh Company, Ltd., and printing operation was carried out. As a result, solid images with excellent uniformity were obtained.

Furthermore, there was no problem caused by the generation of electrostatic charge on the thermosensitive stencil paper No. 3 when the printing master was prepared, and when the printing master was wound around the printing drum.

EXAMPLE 4

A thermoplastic resin comprising a polyester was made into a film with a thickness of 5.8 $\mu m$, which was substantially in the amorphous state with a degree of crystallinity of 5%. The melting temperature of the thermoplastic resin film was 170° C. A commercially available phosphoric ester surface active agent "GAFAC RL210" (Trademark), made by Toho Chemical Industry Co., Ltd. with a melting point of 54° C. and dodecyl trimethylammonium chloride represented by the formula of $C_{12}H_{25}N(CH_3)_2CH_3Cl$, serving as an antistatic agent were mixed with a ratio by weight of 1:1, and the mixture was coated on the surface of the thermoplastic resin film which was in contact with a thermal head in a deposition amount of 0.3 g/$m^2$. Thus, a thermosensitive stencil paper No. 4 for use in the present invention was obtained.

Using the thus obtained thermosensitive stencil paper No. 4, the procedure for preparation of the printing master in Example 1 was repeated except that the applied thermal energy was changed to 0.100 mJ/dot.

The thus prepared printing master was set to a commercially available printing machine "PRIPORT SS 955" (Trademark), made by Ricoh Company, Ltd., and printing operation was carried out. As a result, solid images with excellent uniformity were obtained.

Furthermore, there was no problem caused by the generation of electrostatic charge on the thermosensitive stencil paper No. 4 when the printing master was prepared, and when the printing master was wound around the printing drum.

EXAMPLE 5

A thermoplastic resin comprising a polyester was made into a film with a thickness of 2.5 $\mu m$, which was substantially in the amorphous state with a degree of crystallinity of 1.0%. The melting temperature of the thermoplastic resin film was 160° C. A commercially available phosphoric ester surface active agent "GAFAC RL210" (Trademark), made by Toho Chemical Industry Co., Ltd. with a melting point of 54° C. was coated on the surface of the thermoplastic resin film which was in contact with a thermal head in a deposition amount of 0.1 g/$m^2$ to prevent the thermoplastic resin film from thermally sticking to the thermal head. Thus, a thermosensitive stencil paper No. 5 for use in the present invention was obtained.

Using the thus obtained thermosensitive stencil paper No. 5, a printing master including solid image areas was prepared in such a fashion that the thermal energy of 0.030 mJ/dot was imagewise applied to the thermosensitive stencil paper No. 5 by a partially-glazed thin film line thermal head with a dot density of 16 dot/mm, without providing a platen roller at a position where the thermosensitive stencil paper No. 5 faced to a heating element of the thermal head. The conditions of the partially-glazed thin film line thermal head were as follows:

The length of the heating element in the main-scanning direction (Lm): 60 $\mu m$, the length of the heating element in the sub-scanning direction (Ls): 175 $\mu m$, the width of the heating element central portion in the main-scanning direction (Cm): 40 $\mu m$, the width of the heating element central portion in the sub-scanning direction (Cs): 30 $\mu m$, the sectional area of the heating element end portion (Sp): 60 $\mu m^2$, the sectional area of the heating element central portion (Sc): 40 $\mu m^2$, the thickness of a protective layer of the heating element (T): 4.0 $\mu m$, and the feeding pitch in the sub-scanning direction in preparation of the printing master (Ps): 62.5 $\mu m$/line.

The thus prepared printing master was set to a commercially available printing machine "PRIPORT VT-2500" (Trademark), made by Ricoh Company, Ltd., and printing operation was carried out. As a result, solid images with excellent uniformity were obtained free from the offset problem. In addition, the plate wear of the printing master was sufficient in practical use.

EXAMPLE 6

A thermoplastic resin comprising a polyester was made into a film with a thickness of 7.5 $\mu m$, which was substantially in the amorphous state with a degree of crystallinity of 1.0%. The melting temperature of the thermoplastic resin film was 160° C. A commercially available phosphoric ester surface active agent "GAFAC RL210" (Trademark), made by Toho Chemical Industry Co., Ltd. with a melting point of 54° C. and dodecyl trimethylammonium chloride represented by the formula of $C_{12}H_{25}N(CH_3)_2CH_3Cl$, serving as an antistatic agent were mixed with a ratio by weight of 1:1, and the mixture was coated on the surface of the thermoplastic resin film which was in contact with a thermal head in a deposition amount of 0.2 g/m$^2$. Thus, a thermosensitive stencil paper No. 6 for use in the present invention was obtained.

Using the thus obtained thermosensitive stencil paper No. 6, a printing master including solid image areas was prepared in such a fashion that the thermal energy of 0.050 mJ/dot was imagewise applied to the thermosensitive stencil paper No. 6 by a partially-glazed thin film line thermal head with a dot density of 12 dot/mm, without providing a platen roller at a position where the thermosensitive stencil paper No. 6 faced to a heating element of the thermal head. The conditions of the partially-glazed thin film line thermal head were as follows:

The length of the heating element in the main-scanning direction (Lm): 75 μm, the length of the heating element in the sub-scanning direction (Ls): 175 μm, the width of the heating element central portion in the main-scanning direction (Cm): 50 μm, the width of the heating element central portion in the sub-scanning direction (Cs): 40 μm, the sectional area of the heating element end portion (Sp): 50 μm$^2$, the sectional area of the heating element central portion (Sc): 40 μm$^2$, the thickness of a protective layer of the heating element (T): 4.0 μm, and the feeding pitch in the sub-scanning direction in preparation of the printing master (Ps): 83.3 μm/line.

The thus prepared printing master was set to a commercially available printing machine "PRIPORT VT-2500" (Trademark), made by Ricoh Company, Ltd., and printing operation was carried out. As a result, solid images with excellent uniformity were obtained free from the offset problem. In addition, the plate wear of the printing master was sufficient in practical use.

EXAMPLE 7

A thermoplastic resin comprising polyethylene terephthalate was made into a film with a thickness of 4.0 μm and a degree of crystallinity of 20%. The melting temperature of the thermoplastic resin film was 210° C. A commercially available phosphoric ester surface active agent "GAFAC RL210" (Trademark), made by Toho Chemical Industry Co., Ltd. with a melting point of 54° C. and dodecyl trimethylammonium chloride represented by the formula of $C_{12}H_{25}N(CH_3)_2CH_3Cl$, serving as an antistatic agent were mixed with a ratio by weight of 1:1, and the mixture was coated on both surfaces of the thermoplastic resin film in a deposition amount of 0.2 g/m$^2$. Thus, a thermosensitive stencil paper No. 7 for use in the present invention was obtained.

Using the thus obtained thermosensitive stencil paper No. 7, a printing master including solid image areas was prepared in such a fashion that the thermal energy of 0.030 mJ/dot was imagewise applied to the thermosensitive stencil paper No. 7 by a thin film edge-type thermal head with a dot density of 16 dot/mm, without providing a platen roller at a position where the thermosensitive stencil paper No. 7 faced to a heating element of the thermal head. The conditions of the thin film edge-type thermal head were as follows:

The curvature radius of the end of the heating element (R): 1.2 mm, the length of the heating element in the main-scanning direction (Lm): 60 μm, the length of the heating element in the sub-scanning direction (Ls): 175 μm, the width of the heating element central portion in the main-scanning direction (Cm): 40 μm, the width of the heating element central portion in the sub-scanning direction (Cs): 30 μm, the sectional area of the heating element end portion (Sp): 60 μm$^2$, the sectional area of the heating element central portion (Sc): 40 μm$^2$, the thickness of a protective layer of the heating element (T): 4.0 μm, and the feeding pitch in the sub-scanning direction in preparation of the printing master (Ps): 62.5 μm/line.

The thus prepared printing master was set to a commercially available printing machine "PRIPORT VT-2500" (Trademark), made by Ricoh Company, Ltd., and printing operation was carried out. As a result, solid images with excellent uniformity were obtained free from the offset problem. In addition, the plate wear of the printing master was sufficient in practical use.

COMPARATIVE EXAMPLE 1

Using the same thermosensitive stencil paper No. 1 as prepared in Example 1, a printing master including solid image areas was prepared in such a fashion that the thermal energy of 0.050 mJ/dot was imagewise applied to the thermosensitive stencil paper by a thin film entirely-glazed line thermal head with a dot density of 16 dot/mm, with providing a platen roller comprising a 2.0-mm thick surface layer comprising a silicone rubber at a position where the thermosensitive stencil paper faced to a heating element of the thermal head in order to press the thermosensitive stencil paper toward the heating element because the heating element was located at a concave portion of the thermal head. The conditions of the thin film entirely-glazed line thermal head were as follows:

The length of the heating element in the main-scanning direction (Lm): 45 μm, the length of the heating element in the sub-scanning direction (Ls): 90 μm, the sectional area of the heating element (S): 45 μm$^2$, the thickness of a protective layer of the heating element (T): 4.0 μm, and the feeding pitch in the sub-scanning direction in preparation of the printing master (Ps): 62.5 μm/line.

As a result, perforations corresponding to the images were not formed in the thermosensitive stencil paper.

When the thermal energy applied to the thermosensitive stencil paper by the thermal head was increased to 0.095 mJ/dot, the perforations were obtained to the same extent as in Example 1. However, the obtained perforations lacked the uniformity because of the influence of the surface roughness of the platen roller.

COMPARATIVE EXAMPLE 2

Using the same thermosensitive stencil paper No. 1 as prepared in Example 1, a printing master including solid image areas was prepared in such a fashion that the thermal energy of 0.050 mJ/dot was imagewise applied to the thermosensitive stencil paper by a thin film partially-glazed line thermal head with a dot density of 16 dot/mm, with providing a platen roller at a position where the thermosensitive stencil paper faced to a heating element of the thermal head in order to press the thermosensitive stencil paper toward the heating element because the heating element was located in the concave portion of the thermal head. The conditions of the thin film partially-glazed line thermal head were as follows:

The length of the heating element in the main-scanning direction (Lm): 45 μm, the length of the heating element in the sub-scanning direction (Ls): 90 μm, the sectional area of the heating element end portion (Sp): 45 $\mu m^2$, the sectional area of the heating element central portion (Sc): 45 $\mu m^2$, the thickness of a protective layer of the heating element (T): 4.0 μm, and the feeding pitch in the sub-scanning direction in preparation of the printing master (Ps): 62.5 μm/line.

As a result, perforations corresponding to the images were not formed in the thermosensitive stencil paper.

When the thermal energy applied to the thermosensitive stencil paper by the thermal head was increased to 0.095 mJ/dot, the perforations were obtained to the same extent as in Example 1. However, the obtained perforations lacked the uniformity because of the influence of the surface roughness of the platen roller.

COMPARATIVE EXAMPLE 3

Using the same thermosensitive stencil paper No. 6 as prepared in Example 6, a printing master including solid image areas was prepared in such a fashion that the thermal energy of 0.030 mJ/dot was imagewise applied to the thermosensitive stencil paper by a thin film edge-type thermal head with a dot density of 16 dot/mm, with providing a platen roller at a position where the thermosensitive stencil paper faced to a heating element of the thermal head in order to press the thermosensitive stencil paper toward the heating element because the heating element was located in the concave portion of the thermal head. The conditions of the thin film edge-type thermal head were as follows:

The curvature radius of the end of the heating element (R): 1.2 mm, the length of the heating element in the main-scanning direction (Lm): 45 μm, the length of the heating element in the sub-scanning direction (Ls): 35 μm, the sectional area of the heating element (S): 45 $\mu m^2$, the thickness of a protective layer of the heating element (T): 4.0 μm, and the feeding pitch in the sub-scanning direction in preparation of the printing master (Ps): 62.5 μm/line.

As a result, perforations corresponding to the images were not formed in the thermosensitive stencil paper.

When the thermal energy applied to the thermosensitive stencil paper by the thermal head was increased to 0.055 mJ/dot, the perforations were obtained to the same extent as in Example 6. However, the obtained perforations lacked the uniformity because of the influence of the surface roughness of the platen roller.

COMPARATIVE EXAMPLE 4

Using the same thermosensitive stencil paper No. 6 as prepared in Example 6, a printing master including solid image areas was prepared in such a fashion that the thermal energy of 0.030 mJ/dot was imagewise applied to the thermosensitive stencil paper by a thin film partially-glazed line thermal head with a dot density of 16 dot/mm, with providing a platen roller at a position where the thermosensitive stencil paper faced to a heating element of the thermal head in order to press the thermosensitive stencil paper toward the heating element because the heating element was located in the concave portion of the thermal head. The conditions of the thin film partially-glazed line thermal head were as follows:

The length of the heating element in the main-scanning direction (Lm): 45 μm, the length of the heating element in the sub-scanning direction (Ls): 35 μm, the sectional area of the heating element (S): 45 $\mu m^2$, the thickness of a protective layer of the heating element (T): 4.0 μm, and the feeding pitch in the sub-scanning direction in preparation of the printing master (Ps): 62.5 μm/line.

As a result, perforations corresponding to the images were not formed in the thermosensitive stencil paper.

When the thermal energy applied to the thermosensitive stencil paper by the thermal head was increased to 0.055 mJ/dot, the perforations were obtained to the same extent as in Example 6. However, the obtained perforations lacked the uniformity because of the influence of the surface roughness of the platen roller.

By the manufacturing method of a printing master according to the present invention, the perforations can be formed in the thermosensitive stencil paper corresponding to the images with the uniformity of a solid image by the application of a small amount of thermal energy to the thermosensitive stencil paper.

In particular, as can be seen from the results in Examples 5, 6 and 7, the perforations are clear-cut in the thermosensitive stencil paper, so that the image reproducibility is excellent and the offset problem can be minimized.

The durability of the members concerned in the manufacture of the printing master, particularly the thermal head, in the printing machine can be improved because the printing master can be obtained by the application of a small amount of thermal energy to the thermosensitive stencil paper. In addition, the generation of electrostatic charge can be prevented in the course of the preparation of the printing master, no problem occurs when the thermosensitive stencil paper is wound around the printing drum.

What is claimed is:

1. A method of manufacturing a printing master using a thermosensitive stencil paper having two surfaces and comprising a thermoplastic resin film, comprising the step of:

forming perforations in said thermosensitive stencil paper by applying thermal energy to one surface of said thermosensitive stencil paper through a thermal head, the other surface of said thermosensitive stencil paper being free from contact with any element at a location opposite the thermal head during said application of thermal energy.

2. The method of manufacturing a printing master as claimed in claim 1, wherein said thermal head comprises a plurality of heating elements.

3. The method of manufacturing a printing master as claimed in claim 2, wherein said heating elements of said thermal head are brought into contact with said thermosensitive stencil paper and stick out from an electrically-insulating substrate of said thermal head toward said thermosensitive stencil paper.

4. The method of manufacturing a printing master as claimed in claim 3, wherein each of said heating elements of said thermal head comprises a relatively narrow central portion and relatively wide end portions.

5. The method of manufacturing a printing master as claimed in claim 4, wherein said thermal head is an edge-type line thermal head.

6. The method of manufacturing a printing master as claimed in claim 4, wherein said thermal head is a thin film partially-glazed line thermal head.

7. The method of manufacturing a printing master as claimed in claim 1, wherein said thermoplastic resin film is substantially in the amorphous state.

8. The method of manufacturing a printing master as claimed in claim 1, wherein said thermoplastic resin film has a degree of crystallinity of 15% or less.

9. The method of manufacturing a printing master as claimed in claim 1, wherein said thermoplastic resin film has a thickness of 0.5 to 30 $\mu$m.

10. The method of manufacturing a printing master as claimed in claim 1, wherein said thermoplastic resin film has a melting point ranging from 50° to 300° C.

* * * * *

UNITED STATES PATENT AND TRADEMARK OFFICE

CERTIFICATE OF CORRECTION

PATENT NO. : 5,415,090
DATED : May 16, 1995
INVENTOR(S) : Yuji Natori, et al

It is certified that error appears in the above-indentified patent and that said Letters Patent is hereby corrected as shown below:

Column 3, line 57, delete "mater" and insert --master--.

Signed and Sealed this

Sixth Day of August, 1996

*Attest:*

*Attesting Officer*

BRUCE LEHMAN

*Commissioner of Patents and Trademarks*